US006209874B1

(12) United States Patent
Jones

(10) Patent No.: US 6,209,874 B1
(45) Date of Patent: Apr. 3, 2001

(54) METHOD OF PLAYING A GAME WITH THREE DICE

(75) Inventor: Paul Jones, Las Vegas, NV (US)

(73) Assignee: Paul B Jones, Las Vegas, NV (US)

( * ) Notice: Subject to any disclaimer, the term of this patent is extended or adjusted under 35 U.S.C. 154(b) by 0 days.

(21) Appl. No.: 09/316,052

(22) Filed: May 21, 1999

Related U.S. Application Data

(63) Continuation-in-part of application No. 09/274,192, filed on Mar. 22, 1999.

(51) Int. Cl.[7] ..... A63F 3/00; A63F 9/04
(52) U.S. Cl. ..... 273/274; 273/146
(58) Field of Search ..... 273/274, 146

(56) References Cited

U.S. PATENT DOCUMENTS 4,247,114 * 1/1981 Carroll ..... 273/274
4,334,685 * 6/1982 Robbins ..... 273/274
5,263,715 * 11/1993 Matsumoto et al. ..... 273/138.2
5,308,081 * 5/1994 Bartle ..... 273/274
5,350,175 * 9/1994 DiLullo ..... 273/274
5,413,351 * 5/1995 Franklin ..... 273/274

* cited by examiner

*Primary Examiner*—Benjamin H. Layno

(57) ABSTRACT

A player may make any of six types of wagers on the result of rolling three dice. A first type of wager is on the face-up sides of a selected two of the dice indicating a selected number. A second type of wager is on the face-up side of a selected one of the dice indicating a selected number. A third type of wager is on the face-up side of a selected one of the dice indicating a number that is alternatively higher or lower than numbers indicated by the other two dice. A fourth type of wager is on the face up sides of the dice each indicating a number selected by the player. A fifth type of wager is on the face-up sides of the dice indicating numbers having a sum which is a selected total number. A sixth type of wager is on the sum of numbers indicated by the face-up sides of the three dice being alternatively an odd number or an even number.

10 Claims, 1 Drawing Sheet

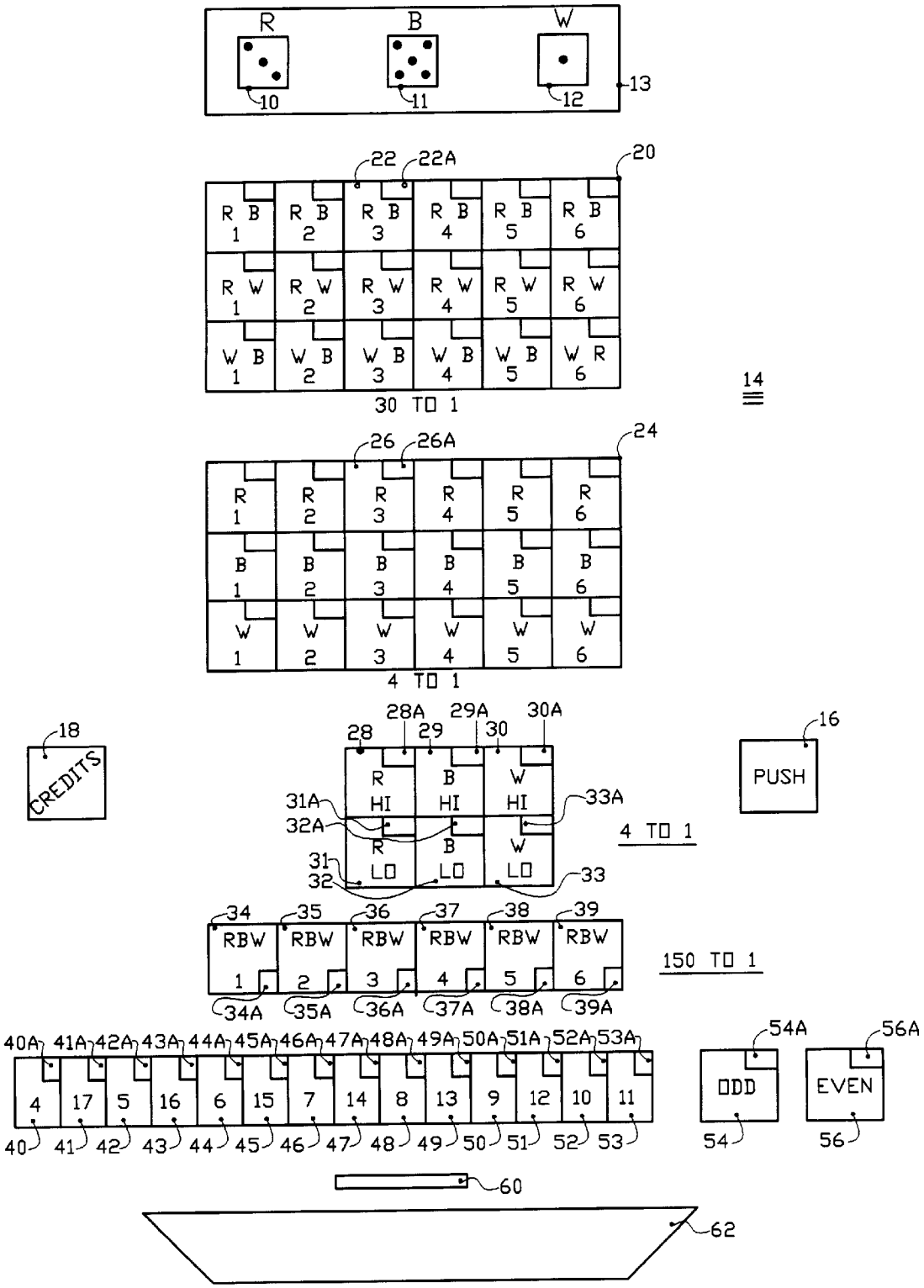
R
B
W
10
11
12
13
22
22A
20
R B 1
R B 2
R B 3
R B 4
R B 5
R B 6
R W 1
R W 2
R W 3
R W 4
R W 5
R W 6
W B 1
W B 2
W B 3
W B 4
W B 5
W R 6
30 TO 1
14
26
26A
24
R 1
R 2
R 3
R 4
R 5
R 6
B 1
B 2
B 3
B 4
B 5
B 6
W 1
W 2
W 3
W 4
W 5
W 6
4 TO 1
18
CREDITS
28A
29A
30A
28
29
30
R HI
B HI
W HI
31A
32A
33A
R LO
B LO
W LO
31
32
33
4 TO 1
16
PUSH
34
35
36
37
38
39
RBW 1
RBW 2
RBW 3
RBW 4
RBW 5
RBW 6
34A
35A
36A
37A
38A
39A
150 TO 1
40A
41A
42A
43A
44A
45A
46A
47A
48A
49A
50A
51A
52A
53A
4
17
5
16
6
15
7
14
8
13
9
12
10
11
40
41
42
43
44
45
46
47
48
49
50
51
52
53
54A
ODD
54
56A
EVEN
56
60
62

METHOD OF PLAYING A GAME WITH THREE DICE

This patent application is a continuation-in-part of a patent application having Ser. No. 09/274192 filed on Mar. 22, 1999.

BACKGROUND OF THE INVENTION

1. Field of Invention

This invention is in the general field of gaming and, more particularly, is a game where a player wagers upon the outcome of a roll of three dice.

2. Background of the Invention

In prehistoric times, a witch doctor engaged in rituals that included throwing knucklebones of sheep upon the ground to read the future. Over many centuries, the knucklebones evolved into dice and the rituals evolved into dice games.

Chuck-a-Luck is an early type of dice game that preferably utilizes a wire cage wherein three captive dice are tossed. The cage is shaped like an hour glass with covered ends. The cage has a narrow waist connected to an encircling metal band. The band is rotatably connected to a shaft.

The dice are tossed by rotating the cage about the shaft. Thereafter, the dice are allowed to come to rest on an end of the cage. Alternatively, the dice can be tossed in a dice cup and cast upon a playing surface which is a feature of Chuck-a-Luck.

The playing surface carries an image of six squares that are aligned side by side. Within the six squares is lettering of the numbers one through six, respectively. Accordingly, each of the squares corresponds to the face of a die. Alternatively, the six squares includes a showing of the six sides of a die.

A player places a wager within any of the six squares. Thereafter, the three dice are tossed. When the cage comes to rest with a face-up side of one of the dice corresponding to a square where the wager is placed, the player wins a one to one payout. When two of the dice each have a face-up side that corresponds, the player wins a two to one payout. When the three dice each have a face-up side that corresponds, the player wins a three to one payout.

From the explanation given hereinbefore, Chuck-a-Luck is a simple game of a type played at a county fair where the player makes one type of wager. Moreover, Chuck-Luck is not a game where large payouts-are made to a winning player. Because the player makes only one type of wager and there are no large payouts, Chuck-a-Luck could not, for example, maintain the interest of players in a casino.

SUMMARY OF THE INVENTION

An object of the present invention is a casino game where a player wagers on the outcome of a roll of three dice.

Another object of the invention is a casino game where a player wagers on the outcome of a representation of a roll of three dice as displayed by a gaming machine.

Another object of the invention is a dice game which can maintain the interest of players in a casino.

Another object of the invention is a dice game that provides large payouts to a winning player.

According to the present invention, three dice, or a representation thereof displayed by a gaming machine, are colored red, blue and white, respectively. A player wagers on the outcome of a roll of three dice or a representation thereof displayed by a gaming machine.

A first type of wager is on the rolling of the dice resulting in the face-up sides of a selected two thereof indicating a number selected by the player.

A second type of wager is on the rolling of the dice resulting in the face-up side of a selected one thereof indicating a number selected by the player.

A third type of wager is on the rolling of the dice resulting in the face-up side of a selected one thereof indicating a number that is alternatively higher or lower than numbers indicated by the face-up sides of the other two dice.

A fourth type of wager is on the rolling of the dice resulting in the face-up sides thereof all indicating a number selected by the player.

A fifth type of wager is on the rolling of the dice resulting in the face-up sides thereof indicating numbers having a sum which is a total number selected by the player.

A sixth type of wager is on the sum of numbers indicated by the face-up sides of the dice being alternatively an odd number or an even number.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of a surface of a gaming machine whereon a game is played with three dice.

DESCRIPTION OF THE PREFERRED EMBODIMENT

In this embodiment, a player of a dice game may make any of six types of wagers relating to the face-up sides of three dice after the dice are rolled. Preferably, the game is played in a casino.

As shown in the drawing, a representation of face-up sides of dice 10, 11, 12 is provided on a video display 13 mounted upon a control panel 14 of a gaming machine. The dice 10–12 are colored red, blue and white, respectively. Because of the colors, the dice 10–12 are distinguishable from each other.

Additionally mounted on the control panel 14 is a pushbutton switch 16 with a lens cover that carries lettering of the word, push. After the player makes a wager, the player depresses the switch 16.

In response to a depression of the switch 16, the display 13 provides a representation of the face-up sides of the dice 10–12 as having been randomly changed. The random changing of the face-up sides of dice is commonly referred to as rolling the dice.

The currency of a wager is a unit of credit. A visual indication of the player's available units of credit is displayed on a readout 18 of any suitable type that is mounted on the control panel 14. Units of credit are explained more fully hereinafter.

A first type of wager is on the rolling of the dice 10–12 resulting in the face-up sides of a selected two thereof indicating a number in the range of one through six. A pushbutton switch matrix 20 is used in connection with the first type of wager. The matrix 20 includes switches with lens covers that respectively carry lettered entries which are given as:

| | | | | | |
|---|---|---|---|---|---|
| RB1 | RB2 | RB3 | RB4 | RB5 | RB6 |
| RW1 | RW2 | RW3 | RW4 | RW5 | RW6 |
| WB1 | WB2 | WB3 | WB4 | WB5 | WB6 |

The player makes the first type of wager by depressing a switch of the matrix 20. A lettered portion of an exemplary entry on the lens cover of the depressed matrix 20 switch is representative of the colors of two of the dice 10–12. A numeric suffix of the exemplary matrix 20 entry is a number in the range of one through six. The player wins the first type of wager when the dice 10–12 are rolled and the two of the dice 10–12 represented by the lettered portion of the exemplary matrix 20 entry indicates its numeric suffix.

A wager on the face-up sides of the dice 10, 11 both indicating the number, three, for example, is made by the player depressing a switch 22 of the matrix 20 as indicated by the lens cover of the switch 22 carrying the lettering of the entry, RB3.

The lens cover of the switch 22 additionally has a rectangle 22A marked thereon. The marking of the rectangle 22A is exemplary of rectangles marked on lens covers of all switches of the matrix 20.

The lens cover of the switch 22 becomes illuminated in response to the switch 22 being depressed. Pushbutton switches with lens covers that become illuminated in response to being depressed are well known to those skilled in the art.

Depressing the switch 22 causes a display of lettering of the number, one, within the rectangle 22A. Pushbutton switches that provide a display of lettering in response to being depressed are well known to those skilled in the art.

In further response to depressing the switch 22, the number of available units of credit is decremented by one. In other words, by depressing the switch 22 once, the player wagers one unit of credit on the rolling of the dice 10–12 resulting in the face-up sides of the dice 10, 11 to both indicating the number, three.

When the switch 22 is depressed more than once, lettering of the number of times it is depressed is displayed within the rectangle 22A and the number of available units of credit is correspondingly decremented. Therefore, the wager on the rolling of the dice 10–12 resulting in the face-up sides of the dice 10, 11 both indicating the number, three, is successively increased by successively depressing the switch 22. After a desired number of units of credit are wagered, the player depresses the switch 16, thereby causing a rolling of the dice 10–12.

It should be understood that a game maintains a favorable competitive position in a gaming environment when the casino makes as large a payout as practical to a winning player while providing a reasonable profit margin to the casino. The probability of the rolling of the dice 10–12 resulting in the face-up sides of the selected two thereof indicating a given number is 1 in 36. Preferably, the casino pays a thirty to one payout to a player who wins the wager on the face-up sides of a selected two of the dice 10–12 indicating the number, thereby making a substantial payout to a winning player and providing a reasonable profit margin to the casino.

A second-type of wager is on the rolling of the dice 10–12 resulting in the face-up side of a selected one thereof indicating a number selected by the player. A pushbutton switch matrix 24 is used in connection with the second type of wager. The matrix 24 includes switches with lens covers that respectively carry lettered entries which are given as:

| | | | | | |
|---|---|---|---|---|---|
| R1 | R2 | R3 | R4 | R5 | R6 |
| B1 | B2 | B3 | B4 | B5 | B6 |
| W1 | W2 | W3 | W4 | W5 | W6 |

The player makes the second type of wager by depressing a switch of the matrix 24. A letter included in an exemplary entry on the lens cover of the depressed matrix 24 switch is representative of the color of the selected one of the dice 10–12. A numeric suffix of the exemplary matrix 24 entry is a number in the range of one through six. The player wins the second type of wager when the dice 10–12 are rolled and the one of the dice 10–12 represented by the lettered portion of the exemplary matrix 24 entry indicates its numeric suffix.

A wager on the face-up side of the die 10 indicating the number, three, for example, is made by the player depressing a switch 26 of the matrix 24 as indicated by the lens cover of the switch 26 carrying the lettering of the entry, R3.

The lens cover of the switch 26 additionally has a rectangle 26A marked thereon which is similar in function to the rectangle 22A described hereinbefore. Moreover, the matrix 24 switches are illuminated in a manner similar to the illumination of the matrix 20 switches.

The probability of the rolling of the dice 10–12 resulting in the face-up side of a selected one thereof indicating a given number, is 1 in 6. Preferably, the casino pays a 4 to one payout to a player who wins the second type of wager, thereby making a substantial payout to a winning player and providing a reasonable profit margin to the casino.

A third type of wager is on the rolling of the dice 10–12 resulting in the face-up side of a selected one thereof indicating a number that is alternatively higher or lower than numbers indicated by the face-up sides of the other two of the dice 10–12. A group of pushbutton switches 28–32, mounted on the control panel 14, are used in connection with the third type of wager.

Depressing the switch 29, for example, results in a high blue wager whereby one credit unit is wagered that the rolling of the dice 10–12 results in the face-up side of the die 11 (the blue die) indicating a number that is higher than numbers indicated by the dice 10, 12 (the red and the white dice). Additionally, the player can make high red and high white wagers as well as low red, low blue and low white wagers.

Depressing the switch 31, for example, results in a low red wager whereby one credit unit is wagered that the rolling of the dice 10–12 results in the face-up side of the die 10 (the red die) indicating a number that is lower than numbers indicated by the dice 11, 12 (the blue and the white dice).

Lens covers of the switches 28–33 have rectangles 28A–33A, respectively, marked thereon which are similar in function to the rectangle 22A described hereinbefore. Moreover, the lens covers of the switches 28–33 are illuminated in a manner similar to the illumination of the lens covers of the matrix 20 switches.

When any of the switches 28–33 is depressed more than once, lettering of the number of times it is depressed is displayed in rectangles 28A–33A, respectively, of the switches 28–33. Displays within the rectangles 28A–33A are similar to the display within the rectangle 22A described hereinbefore. Preferably, the casino makes a four to one payout to a winner of a high wager and to a winner of a low wager.

A fourth type of wager is on the rolling of the dice 10–12 resulting in the face-up sides thereof indicating a number in the range of one through six. Pushbutton switches 34–39, mounted on the control panel 14, are used in connection with the fourth type of wager. The switches 34–39 have lens covers that respectively carry lettered entries which are given as:

RBW1 RBW2 RBW3 RBW4 RBW5 RBW6

A wager on the rolling of the dice 10–12 causing the face-up sides thereof to all indicate the number three, for example, is selected by the player depressing the switch 36 which has the lens cover that carries the lettering of a numeric suffix, three. The probability of the dice 10–12 all indicating the number three (or any other number), is 1 in 216.

In this embodiment, the casino pays a one hundred fifty to one payout to a player who wins the wager on the face-up sides of the dice 10–12 all indicating the number, three, thereby making a substantial payout to a winning player and providing a reasonable profit margin to the casino.

Lens covers of the switches 34–39 have rectangles 34A–39A, respectively, marked thereon which are similar in function to the rectangle 22A described hereinbefore. Moreover, the lens covers of the switches 34–39 are illuminated in a manner similar to the illumination of the lens covers of the matrix 20 switches.

A fifth type of wager is on the rolling of the dice 10–12 resulting in face-up sides thereof indicating numbers having a sum which is a total number selected by the player. A group of pushbutton switches 40–53, mounted side by side on the control panel 14, are used in connection with the fifth type of wager.

Each of the switches 40–53 has a lens cover that carries lettering of a total number. The range of the total numbers is four through seventeen. The player selects a total number by depressing one of the switches 40–53. The total number fifteen, for example, is selected by the player depressing the switch 45.

The probability of the rolling of the dice 10–12 resulting in the total number, fifteen, is 10 in 216. In this embodiment, the casino pays a fifteen to one payout to a player who wins the wager on the total number, fifteen, thereby making a substantial payout to a winning player and providing a reasonable profit margin to the casino. In a manner similar to that described hereinbefore, others of the switches 40–53 may be depressed to make a wager on a total number other than fifteen.

The probability of a roll of the dice resulting in a total number and payouts to the winning player are in accordance with a table which is given as:

| Total Number | Probability | Payout |
|---|---|---|
| 4, 17 | 3/216 | 60:1 |
| 5, 16 | 6/216 | 25:1 |
| 6, 15 | 10/216 | 15:1 |
| 7, 14 | 15/216 | 12:1 |
| 8, 13 | 21/216 | 9:1 |
| 9, 12 | 25/216 | 7:1 |
| 10, 11 | 27/216 | 6:1 |

Lens covers of the switches 40–53 have rectangles 40A–53A, respectively, marked thereon which are similar in function to the rectangle 22A described hereinbefore. Moreover, the lens covers of the switches 40–53 are illuminated in a manner similar to the illumination of the lens covers of matrix 20 switches.

A sixth type of wager is on the sum of numbers indicated by the face-up sides of the dice 10–12 being alternatively an odd number or an even number. Pushbutton switches 54, 56, mounted on the control panel 14 are used in connection with the sixth type of wager. More particularly, the player wagers that the sum is odd by depressing the switch 54. The wager that the sum is even is made by depressing the switch 56.

The sum being odd and the sum being even are equally probable events. In this embodiment, the casino pays a one to one payout when the player wins a wager on these events. The casino is provided a margin of profit and a winning player is provided a substantial payout by having the player lose the wager on these events when the sum is either the number, three, or the number, eighteen.

Lens covers of the switches 54, 56 have rectangles 54, 56, respectively, marked thereon which are similar in function to the rectangle 22A described hereinbefore. Moreover, the lens covers of the switches 54, 56 are illuminated in a manner similar to the illumination of the lens covers of matrix 20 switches.

The gaming machine additionally includes a coin slot 60 where a player may insert coins. In response to the insertion of the coins, the number of available units of credit are correspondingly incremented.

The gaming machine further includes a return tray 62. The gaming machine makes a payout by disgorging coins into the return tray 60.

While the invention has been particularly shown and described with reference to a preferred embodiment thereof, it should be understood by those skilled in the art that changes in form and detail may be made therein without departing from the spirit and scope of the invention.

I claim:

1. In the method of playing a dice game in a casino, comprising the steps of:

providing three dice or a representation thereof on a gaming machine, each of said three dice being visually distinguishable from each other, with a first die colored red, a second die colored blue and a third die colored white, each die having a plurality of faces, each face distinguishably numbered in sequence, wherein all three dice having the same numbering sequence;

permitting a player to wager that a rolling of said dice or a representation of said roll by a gaming machine, results in the face-up sides of said dice each indicating a number selected by said player;

permitting said player to wager that said result is the face-up sides of said dice indicating numbers having a selected total;

permitting said player to select a number from said numbering sequence and to select two of said dice, and permitting said player to wager that a rolling of all three of said dice or a representation of said roll by a gaming machine, results in the face-up sides of said selected two dice each indicating said selected number.

2. In the method of claim 1, the additional step of said casino paying a payout to said player when said result is said selected total, where the probability of said total being said result and said payout are in accordance with a table which is given as:

| Total Number | Probability | Payout |
|---|---|---|
| 4, 17 | 3/216 | 60:1 |
| 5, 16 | 6/216 | 25:1 |
| 6, 15 | 10/216 | 15:1 |
| 7, 14 | 15/216 | 12:1 |
| 8, 13 | 21/216 | 9:1 |
| 9, 12 | 25/216 | 7:1 |
| 10, 11 | 27/216 | 6:1. |

3. In the method of claim 1, the additional step of said casino making a payout to said player of one hundred fifty to one on said wager that the face-up sides of each of said dice indicates said number selected by said player.

4. In the method of claim 1, the additional step of permitting said player to wager that said result is that the sum of numbers indicated by the face-up sides of said dice is an odd number.

5. In the method of claim 4, the additional step of said casino making a one to one payout to said player when said sum is an odd number other than a predetermined odd number.

6. In the method of claim 1, the additional step of permitting said player to wager that said result is that the sum of numbers indicated by the face-up sides of said dice is an even number.

7. In the method of claim 6, the additional step of said casino making a one to one payout to said player when said sum is an even number other than a predetermined even number.

8. In the method of claim 1 wherein said player makes said wager of said selected two dice each indicating said selected number by depressing a switch of a matrix of switches with lens covers that respectively carry lettered entries which are given as:

| | | | | | |
|---|---|---|---|---|---|
| RB1 | RB2 | RB3 | RB4 | RB5 | RB6 |
| RW1 | RW2 | RW3 | RW4 | RW5 | RW6 |
| WB1 | WB2 | WB3 | WB4 | WB5 | WB6, |

wherein R corresponds to said red die, B corresponds to said blue die, W corresponds to said white die, and the numbers 1 through 6 correspond to the numbers on said dice.

9. In the method of playing a dice game in a casino, comprising the steps of:

providing three dice, or a representation thereof on a gaming machine, each of said three dice being visually distinguishable from each other, each die having a plurality of faces, each face distinguishably numbered in sequence, and all three dice having the same numbering sequence;

permitting a player to select one of said dice, and permitting said player to make a wager that said rolling of all three of said dice, or a representation of said roll by said gaming machine, results in a face-up side of said selected die indicating a number that is alternatively higher or lower than numbers indicated by the face-up sides of the other two dice.

10. In the method of claim 9, including the additional step of permitting said player to make a wager that said rolling of said dice, or a representation thereof by said gaming machine, results in a face-up side of a selected one of said dice indicating a selected number.

* * * * *